8-108.1 SR
F6966 XR. 4,396,388

United States Patent [19]
Hojo et al.
[11] 4,396,388
[45] Aug. 2, 1983

[54] METHOD OF MODIFYING ANIMAL FIBER GOODS BY STRIPPING OFF SCALES

[76] Inventors: Hiroshi Hojo, 59-I, Aza Fumizoe, Oaza Ryodakaya, Konan-shi, Aichi 483; Sadao Noguchi, 85, Narukocho, 4-chome, Midori-ku, Nagoya-shi, Aichi 458, both of Japan

[21] Appl. No.: 296,263

[22] PCT Filed: Jan. 21, 1981

[86] PCT No.: PCT/JP81/00015

§ 371 Date: Aug. 20, 1981

§ 102(e) Date: Aug. 20, 1981

[87] PCT Pub. No.: WO81/02752

PCT Pub. Date: Oct. 1, 1981

[30] Foreign Application Priority Data

Sep. 27, 1980 [JP] Japan ..... 55-39702

[51] Int. Cl.[3] ..... D06M 3/08; D06M 3/06

[52] U.S. Cl. ..... 8/94.14; 8/128 R; 8/108 A

[58] Field of Search ..... 8/94.14, 128 R, 108 A

[56] References Cited

U.S. PATENT DOCUMENTS 3,062,610 11/1962 Russon ..... 8/128 R
3,076,690 2/1963 Hayashi ..... 8/128 R
4,319,879 3/1982 Hojo et al. ..... 8/128 R

FOREIGN PATENT DOCUMENTS 39-5992 4/1964 Japan ..... 8/128 R

*Primary Examiner*—Maria Parrish Tungol
*Attorney, Agent, or Firm*—Armstrong, Nikaido, Marmelstein & Kubovcik

[57] ABSTRACT

This present invention relates to a method of improving the quality of animal fibers collected from sheep, goat, llama, or alpaca by removing scales.

Firstly, (a), an oxidizing catalyst is absorbed in the hydrophilic areas on the surface of a fiber, that is, the joint sections (2) of the scales (1) and the end cuticles (3). Then, (b), the fiber is immersed in a solution of a chlorinating agent or an oxidizing agent to decompose the scales rapidly by oxidation in order to remove the scales (1). Then, (c), the fiber is treated with a solution of a reducing agent. The above process (a) is carried out by processing the acid to be used as a catalyst in a solution of a simple salt consisting strong acid and weak base or in an acidic gas in order to absorb it to the bonded moisture of the sections (2) and (3), or by bonding to the hydrophilic areas of the section (2) and (3) in a solution containing transition elements, Mg, or Al as ions, or in an organic solvent in which said solution is dispereded, after producing chelete bonding of said metals.

This present invention improves the quality of blended products with animal fibers or furs efficiently in a short time at a room temperature.

9 Claims, 5 Drawing Figures

METHOD OF MODIFYING ANIMAL FIBER GOODS BY STRIPPING OFF SCALES

DESCRIPTION

TECHNICAL FIELD

The term "animal fiber" used in this invention means those fibers which have a fine structure having scales and are collected from land mammalia such as sheep, goat, Llama, Alpaca and other animals analogous to them, and the term "fur" means those which are covered with the fiber having the abovementioned scale structure.

Unlike the conventional method of treating wool, the present invention is essentially directed to modify and upgrade the quality of the animal fiber goods by decomposing and stripping off only the scales of the animal fibers without damaging the internal cortical cells.

The surface of the animal fibers to be treated in the present invention has a fine structure covered with the scales which are flat, laminated with one another like roofing tiles and which have an extremely high water repelling property. However, the interior of the scales covered as a whole with the water-repelling films consists of proteins called "Endo Cuticle" having a composition composed of a large number of polar groups such as carboxyl groups, amino groups and the like and which easily absorb water. These portions open to the inter-scale gaps and serve as the permeation canals of the water as depicted in FIGS. 1 and 3. The water first permeates into the Endo Cuticle and swells it so that edges rise until at last the water perfectly permeates into the Cortex inside the wool.

BACKGROUND ART

In the conventional method of imparting crease resistance to a wool fiber by use of a chlorinating agent or an oxidizing agent, even if an attempt is made to restrict the action of the agent to the scale surface, the action reaches the cortex so long as the method is practised in an aqueous solution so that the oxidation permeates unlimitedly into the interior of the fiber and renders the interior of the fiber brittle and damaged. If the action is insufficient, the result also becomes inevitably insufficient. Even if the reaction is terminated at an intermediate stage or an organic oxidizing agent exhibiting its action is employed relatively slowly, it is not possible to restrict the degree of oxidation, and decomposed products during the oxidation again deposit onto the fiber surface and reduce the color fastness properties of the fiber. Thus, the conventional method is not free from various mechanical problems.

In the method which allows the animal fiber to first contain acids, so long as the method is carried out in an aqueous solution, the acids unlimitedly permeate into the interior of the fiber through the permeation canals of the moisture so that it becomes practically impossible to limit the oxidation to the surface of the animal fibers.

The method of the present invention accomplishes the modification of the animal fiber goods by the steps of first allowing limited portions of the scales on the surface of the animal fibers to adsorb a pro oxidizing-catalyst that promotes the oxidation decomposition by the chlorinating agent or oxidizing agent, then dipping the goods in the solution of the chlorinating agent or oxidizing agent, performing the oxidation while restricting the oxidation only to the surface portions of the animal fiber thereby to strip off only the scale portions upon which the oxidation acts, thus carrying out the treatment under such conditions that do not at all damage the cortex inside the fiber.

Though the surface of the wool fiber has an extremely high water repelling property, the water is likely to be adsorbed onto the endo cuticle at the edge portions. This fact is illustrated by the following literature:

(1) Kokusai Yomo Jimukyoku, 11-46, 1-chome, Akasaka, Minato-Ku, Tokyo-to, published on June 30, 1976, "Crimp, Wool and Tecnhiques", No. 33, p. 3–9, edited by Ryoji Nakamura, "Structure of epidermis cuticle layer of wool".

DISCLOSURE OF INVENTION

The essential point of the condition for practising each step of the present invention will be described stepwise in detail.

(1) Acid ions, that is, hydrogen ions, are first dissolved in the inherent moisture retained ordinarily in the endo cuticle portions of the scales of the animal fibers in the same way that free water is not found. Namely, the acid, that is, an inorganic acid or organic acid as the hydrogen ion source is primarily contained in sodium chloride or sodium sulfate, that is, a saturated solution by neutral salt of strong electrolyte if the treatment is carried out in an aqueous solution, while preventing the permeation of the water into the fiber. Alternatively, the acid is changed into an anhydrous gas and is then dissolved in the inherent moisture of the animal fibers.

The hydrogen ion source to be used here may be such acids as hydrochloric acid, sulfuric acid, formic acid, acetic acid and the like, but they must not, in particular, contain a peroxyl group for the following reason. Such a compound is an oxidizing agent which oxidizes and decomposes the animal fibers and when used, it would allow the reaction to proceed further inwardly. Accordingly, acids such as persulfuric acid, peracetic acid and the like cannot be used.

From the object of use of the hydrogen ion source, its combined anion must naturally be inactive to the oxidizing agent to be used in the subsequent step. Simple salts consisting of strong acid and weak base providing the hydrogen ions in an aqueous solution accomplish the same object in the form of a saturated solution. However, a step that brings the starting material into contact with the water prior to the step of placing the material in the bath of the oxidizing agent must be avoided by all means after the method which dissolves the acid in the inherent moisture under the condition in which free water is not found.

(2) Next, in the method which makes use of the character of the amino acid composition of the endo cuticle-forming portions, the metals listed below are coordinate-bonded to the carboxyl group and amino group that are present in large quantities in the endo cuticle portions. Namely, as soon as the animal fibers are immersed in an aqueous solution of about 30° C. containing 0.01 to 0.05% owf in terms of weight ratio of metallic ions such as cobalt, nickel, palladium, platinum, copper, iron, chromium, zinc, aluminum or magnesium, the metallic ions are adsorbed as a chelate onto the permeation canal of the water and onto the endo cuticle portions. In this case, the metal is adsorbed onto the endo cuticle in the aqueous solution containing the metal as the ions or in the solution of an organic solvent dispersing therein the metal in the ion form at a pH suited for the adsorption of the ions to avoid swelling of the fiber lest the adsorption reach the innermost portions of the material to be treated.

Next, the animal fiber treated by the abovementioned method (1) or (2) is immersed in the solution of an alkali metal salt, e.g., hypochlorite, chlorite or chlorocyanuric acid or in the solution of an oxidizing agent, e.g., persulfuric acid, peracetic acid or potassium permanganate, whereby drastic oxidized decomposition is effected at the limited endo cuticle portions by the oxidizing agent due to the positive catalytic action of the hydrogen ions or the bonded metal at the endo cuticle portions. Consequently, only the scales are stripped off without damaging the internal cortex at the other portions.

Next, the residue is dissolved and removed by the treatment using a reducing agent such as sodium pyrosulfite, sodium hyposulfite, sodium sulfite or thioglycollic acid, and the treated surface becomes smooth.

Furthermore, in accordance with the method of the present invention, it is possible to remove the scales from the animal fiber that has already been rendered felt, creased and solidified and to change it into an animal fiber product that has durability and does not change into the felt.

Figure 1:
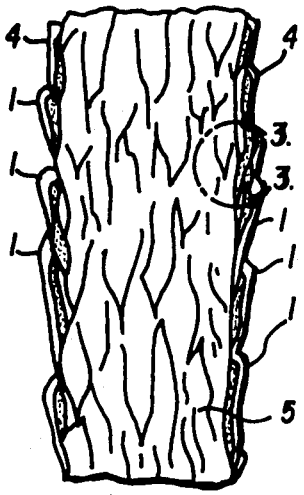
FIG. 1 is an enlarged longitudinal sectional view of the animal fiber in the axial direction of the fiber.
Figure 2:
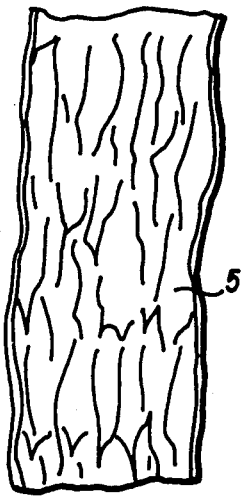
FIG. 2 is an enlarged view of the same after finish in accordance with the present invention.

Photo No. 1 is a micrograph of the fine surface of the animal fiber of FIG. 1 as it is magnified 2,000 times by a scanning electron microscope; and Photo No. 2 is a magnified micrograph of the fine surface of the animal fiber of FIG. 2 treated in accordance with the method of the present invention and magnified 2,000 times by a scanning electron microscope.

In the drawings, reference numeral 1 represents scales, 2 represents hydrophilic portions opening to the interscale gaps, 3 the endo cuticle, 4 the epicuticle and 5 the cortex.

BEST METHOD FOR CARRYING OUT THE INVENTION

Hereinafter, the method of modifying the animal fiber goods by stripping off the scales in accordance with the present invention will be described step-wise in a definite manner with reference to embodiments thereof.

Example 1

The wool top of the Lincoln type produced in England, having a diameter of 36.5μ, was immersed in the solution having the following composition at 20° C. for 3 minutes, and was then squeezed 80% and dehydrated:

| | |
|---|---|
| common salt | 0.31 kg/l |
| hydrochloric acid (35% hydrogen chloride) | 60 cc/l |

Next, the wool top was immersed in a solution formed by adding hydrochloric acid to sodium hypochlorite, available chlorine 6% owf, bath ratio 1:15, and a pH adjusted to 6.5. The solution was circulated at 20°–22° C. for 3 minutes, and the wool top was dehydrated and washed with cold water. Thereafter, it was treated in the solution listed below at 25° C. for 3 minutes, dehydrated and then washed with hot water of 35° C.:

| | |
|---|---|
| sodium pryosulfite | 10 g/l |
| aqueous ammonia (25% solution) | 14 cc/l |
| bath ratio | 1:10 |

After a solution consisting of 3 g/l of formaline and 3 g/l of rongalit and having a bath ratio of 1:10 was adjusted to pH 5 by acetic acid, the wool top was treated with this solution at 80° C. for 30 minutes, washed with water and then dried, thereby completing the treating processes of the present invention.

As a result of microscopic observation, it was found that almost all scales were removed from the wool fiber thus treated and the fiber was imparted with beautiful mohair-like luster and smooth feeling so that a loop yarn, a fabric, a knitted good or a mohair that were conventionally produced as mix-spun products could be used as a substitute for the mohair. Worthy of special mention was that touch and feeling, washability and dyeability of the product were remarkably improved and a quality product could be obtained.

Besides, various excellent products could be obtained from various different materials as listed below.

(1) When the baby alpaca of a 22-diameter was treated in accordance with the method of the present invention, the material was changed into a product having mohair-like appearance and smooth feeling. Thus, the material was modified into a novel high-quality fiber that was even finer than the mohair, that occurred naturally only as one having a diameter of 24μ, and was analogous to ultra-high quality mohair.

(2) When the wool top of the merino type having an average diameter of 18μ was treated in accordance with the present invention, there was obtained a product having excellent feeling and free from piercing feeling that was inherent to the wool. The woven or knitted fabric produced from the product had perfect crease resistance and exhibited a special feeling.

Besides ① the common salt used in Example 1 of the present invention, it is possible to use neutral salts such as sodium sulfate, potassium chloride or magnesium sulfate. Besides ② hydrochloric acid used in Example 2, it is possible to use acids such as sulfuric acid, phosphoric acid, sulfamic acid, isoamylsulfonic acid, o-phenolsulfonic acid, mataphosphoric acid, sulfosalicyclic acid, octylsulfuric acid, dodecylsulfuric acid, pyrosulfuric acid, dodecylsulfonic acid, dichloroacetic acid, monochloroacetic acid, formic acid, glycolic acid, acetic acid, propionic acid, benzoic acid or p-nitrophenol.

③ Instead of the combination of the saturated solution of the neutral salt with the acid, the present invention can be practised in the saturated solution of the simple salt consisting of strong acid and weak base, that provides the similar effect and the hydrogen ions in the aqueous solution, such as ammonium salts, calcium salts, magnesium salts or the like of the strong acid.

④ In addition to sodium hypochlorite illustrated as the oxidizing agent, it is also possible to use sodium chlorite, sodium chlorocyanurate, potassium chlorocyanurate, chloroamine, monopersulfate, peracetate, potassium permanganate and sodium peroxide.

⑤ In addition to the aforementioned sodium pyrosulfite, it is possible to use, as the reducing agent, sodium hyposulfite, sodium sulfite or thioglycolic acid.

Example 2

A wool sweater made of the Australian merino wool having a diameter of 21.5μ was placed inside a current of hydrogen chloride vapor for about 20 minutes, and then immersed in an aqueous solution of sodium dichlorocyanurate having available chlorine of 4% owf and a bath ratio of 1:15 at 25° C. for 25 minutes, and was thereafter washed by a rotary washer. At 3 minutes after washing, the sweater was treated at 30° C. for 5 minutes in a bath of 5 g/l of sodium pyrosulfite and 10 g/l of sodium hydrogen carbonate and was then washed with hot water of 40° C. for 10 minutes. As a result of the microscopic observation, it was confirmed that the scales were removed from the sweater thus treated. The sweater had beautiful luster and even after being washed for 3 hours by the washing machine, it exhibited a crease resistance of 1.4% which is almost perfect.

Example 3

The wool top of the Australian merino wool was immersed in a 0.015% nickel chloride solution, or, an aqueous solution of 36 ppm, calculated as the nickel ions, at 28° C. for 10 to 15 seconds and was immediately washed with water. Next, the wool top was immersed in a solution of sodium hypochlorite having 6% owf of available chlorine and a bath ratio of 1:15 which was adjusted to pH 6.5 by adding thereto hydrochloric acid and held at 20° C. After the solution was circulated for 2 minutes, the wool top was dehydrated and was washed with water. Next, the wool top was immersed in a solution of 5 g/l of sodium pyrosulfite and 7 g/l of aqueous ammonia (25% solution) and a bath ratio of 1:15 for 3 minutes. After the wool top was dehydrated, mechanical operation was applied and the scales that were separated and stripped off were washed away.

Thereafter, the wool top was immersed in a bath of 5 cc/l of formaline (35%) having a liquor ratio of 1:15 at 50° C. for 30 minutes, and was then dehydrated, washed with water and dried to complete the treatment.

The wool thus treated had a beautiful luster and smooth feeling. As a result of the microscopic observation, it was confirmed that at least 90% of the scales were removed. In this manner, the test result similar to that of Example 1 could be obtained.

A men's sweater knitted from Count No. 33 two ply yarn of this wool by a 12-gauge FF knitting machine exhibited crease resistance capable of withstanding the washing by a washing machine, had elasticity inherent to the wool, cashmere-like feeling and bulkiness and was free from a piercing feeling when it was put on. When the sweater was dyed in a dense color such as crimson, navy blue or black, it had a deep color tone that could not be attained conventionally, and its rubbing fastness reached the 4 to 5 class.

In addition, various excellent products could be obtained from various different materials as illustrated below.

(1) When a mixed spun knitted fabric consisting of 45% modified, anti-pilling polyester and 55% wool was treated in the same way as in Example 3 of the present invention, it became a knitted product that could be washed as a whole by a washing machine. As a result of the test carried out in accordance with JISL-1076 using an ICI-pilling tester, it was found that the product was improved by one class as compared with the conventional product.

(2) After the wool fur was treated with the method of the present invention, it was applied with a smoothing agent, repeatedly carded and then dried. The resulting product had a beautiful luster and smooth feeling and was thus modified into a product having a quality which was such improved over the wool fur before treatment.

Besides nickel chloride illustrated in ① of Example 3 of the present invention, it is possible to use those compounds which, when hydrated in the form of chloride, fluoride, sulfate, nirate or acetate, exhibit chelation as complex aqueous ions. Examples of such compounds are those of cobalt, iron, nickel, platinum, copper, palladium, chromium, cadmium, manganese, zinc, lead, tin, mercury, silver, antimony, bismuth, selenium, aluminum, magnesium and so forth.

Besides sodium hypochlorite illustrated as the oxidizing agent in ② of Example 3, it is also possible to use sodium chlorite, sodium chlorocyanurate, potassium chlorocyanurate, chlorinated amine, monopersulfuric acid, persulfuric acid, peracetic acid and hydrogen peroxide.

Besides sodium pyrosulfite illustrated as the reducing agent in ③ of Example 3, it is also possible to use sodium hyposulfite, sodium sulfite or thioglycolic acid.

Example 4

Golf wear, sweaters or vests that were made of 100% wool, felt-solidified after wear and washing and creased by 20 to 30% were wrapped by a polyester net and were treated at 25° C. for 2 minutes in a drum type solvent machine containing a solution formed by dispersing sorbitan laurate, together with 0.05 cc/l of water, in 1,1,1-trichloroethane in such a manner that $CrF_3$ became 35 ppm calculated as chromium ion. The materials were dehydrated and the solvent was removed. Thereafter, the materials to be treated were treated at 25° C. for 2 minutes in a bath of sodium hypochlorite having 5% owf of available chlorine and a bath ratio of 1:10 and adjusted to pH 6.5. The materials were then dehydrated and washed with water to remove the decomposed and stripped matters. Next, the materials were treated in an aqueous solution of 3 g/l of sodium pyrosulfite having a bath ratio of 1:10 at 35° C. for 5 minutes, neutralized with 2 g/l of sodium hydrogen-carbonate, washed with water and then dried to complete the treatment of the present invention.

As a result of this treatment, stains on the surface of the fiber goods and the felted portions were removed together with the scales and the stiches again appeared. Shrinkage returned close to the fresh product and the fiber goods exhibited elasticity and bulkiness that were not found in the fresh products. Further, color became vivid, feeling became soft and a piercing feeling inherent to the wool was eliminated. The fiber goods were endowed with wash resistance as well.

Besides 1,1,1-trichloroethane illustrated as the organic solvent in Example 4, it is possible to use perchloroethylene, trichloroethylene, industrial gasoline No. 5 kerosene, carbon tetrachloride and so forth.

Besides sorbitan laurate illustrated in Example 4, it is also possible to use anionic or nonionic organic surfactants for organic solvents.

As the metallic compounds for the catalyst, the oxidizing agent and the reducing agents, it is possible to use those illustrated in Example 3.

Industrial Applicability

The present invention can be used for up-grading the quality of a mixed spun product consisting of an animal fiber and a synthetic fiber by removing the scales from the animal fiber. It can also be used widely as a method of up-grading the quality of a fur which has inferior feeling due to the presence of the scales and in which the hair tips are likely to be entangled with one another.

Since the treatment of the present invention can be carried out at a temperature near normal temperature within only a few minutes of time, the dyes are hardly decomposed and the shapes imparted to the fiber product such as twisting, knitting, sawing and the like are not deformed. Thus, the fiber product can be modified into a high quality product without spoiling the fiber strength and the leather portions of the fur.

Next, the essential points of the fine structure, object, action and effect of the method of modifying the animal fiber products by stripping off the scales in accordance with the present will be described in detail with reference to the accompanying drawings and scanning electron micrographs.

Figure 3:
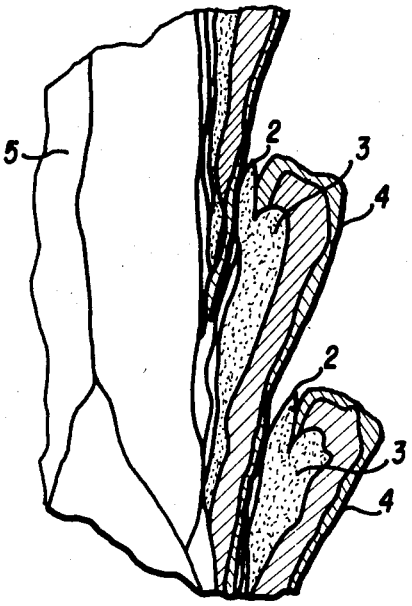
FIG. 3 is an enlarged view showing the fine structure of the portion encircled in FIG. 1.

FIG. 1 is a longitudinal sectional enlarged view of the animal fiber in the axial direction of the fiber and Photo No. 1 is a scanning electron mixrograph showing its fine structure in magnification of 2000X;

FIG. 2 is a longitudinal sectional enlarged view of the animal fiber from which the scales are stripped off in accordance with the method of the present invention and Photo No. 2 is a scanning electron micrograph showing its fine surface structure in magnification of 2000X; and FIG. 3 is an enlarged view of the encircled portion of FIG. 1.

FIG. 1 and Photo No. 1 show the state of arrangement of the scales 1 in which the surfaces of the animal fibers are superposed one upon another like roofing tiles. Bobbin-like cells referred to as "cortex" 5 form its internal layer, and the scales 1 are covered with epicuticle 4 which is a water-repelling film. Accordingly, the surface of the animal fiber exhibits the water-repelling property. However, the interscale gaps form a canal 2 having open hydrophilic portions as shown in FIG. 3. The hydrophilic portion continuing the endo cuticle portion 3, which is indicated by dotted lines, absorb the water from the canal portion 2 when the animal fiber is dipped into water, though the surface has the water-repelling property. As a result, the scales rise and the fiber is likely to be felted. This phenomenon is well known and is also one of the inherent characteristics and drawbacks of the animal fiber that cannot be found in other fibers.

The present invention takes advantage of this drawback, on the contrary. First, chemicals serving as the oxidation catalyst are adsorbed onto the hydrophilic canal 2 and the hydrophilic portion of the endo cuticle 3. When the animal fiber is then immersed in the solution of the oxidizing agent, the hydrophilic canal 2 and the portion of the endo cuticle 3 undergo rapid oxidation decomposition and are rapidly dissolved so that the scales I collapse and are stripped off from the inside contacting with the internal layer 5.

Next, the oxidation is stopped by use of the reducing agent and at the same time, the residual portions are removed by means of reduction whereby only the scale portions are stripped off from the animal fiber goods as shown in FIG. 2 and Photo No. 2.

In other words, though the interior of the scales has a structure which is easily swollen and is easy to rise, the method of the invention does not exert an influence upon the internal layer but dissolved only this swelling portion in order to strip off the scales.

(1) When the animal fiber goods are immersed in a saturated solution of a neutral salt such as sodium chloride or sodium sulfate containing an acid such as hydrochloric acid, sulfuric acid, acetic acid, formic acid, monochloroacetic acid or dichloroacetic acid, deposition and wetting of the water occur on the surface of the animal fiber in the saturated solution by neutral salt of these strong electrolytes, but the water does not easily permeate into the interior of the fiber.

Namely, as shown in FIG. 1 and in FIG. 3 which is an enlarged view of the encircled portion at the upper portion of FIG. 1, the scales I of the animal fiber are covered with the water-repelling film referred to as "epi cuticle" 4, are as a whole furnished with the water-repelling property and are hardly wetted. However, on the back of the scales 1 are a protein layer referred to as "endo cuticle" 3 that contains a great number of polar groups, and is open at the inter-scale gaps, thus allowing easy passage of the water.

Under the normal condition, the animal fiber contains about 15% water as the inherent moisture at the open portions of the scales. When an acid or a neutral salt is about to be dissolved in this inherent moisture such as when hydrochloric acid is used in combination with a saturated sodium chloride solution, for example, the hydrogen ion of hydrochloric acid exhibits the diffusion velocity of 4 to 5 times that of the sodium ion of sodium chloride even at normal temperature and hydrochloric acid is dissolved more rapidly than sodium chloride so that the acid is contained only in the portions of the endo cuticles 3 with the other portions being un-corroded by the acid. In this case, a surfactant that would possibly hinder the saturated solution of the neutral salt used, should never be employed.

When the animal fiber is exposed in the current of hydrogen chloride gas or the like, the gas is dissolved in the endo cuticle having a large amount of the fixed moisture, thereby effecting the limited adsorption in the same way as mentioned above.

(2) As another method, when the animal fiber is immersed in an aqueous solution having dissolved therein 20 to 50 ppm, calculated as aqueous ion or complex ion, of trace amounts of a transition metal (transition elements) such as cobalt, nickel, palladium, platinum, copper, iron, chromium, zinc, etc, or aluminum or magnesium, or in an organic solvent dispersing therein the abovementioned aqueous solution, the treating liquor passes through the portions through which it is easy to pass, in the same way as the abovementioned acid so that the metal is adsorbed in the state as it is coordinated to the polar group of the endo cuticle.

(3) Next, when the animal fiber is immersed in an aqueous solution containing a predetermined amount of the oxidizing agent such as sodium hypochlorite, sodium chlorite, sodium chlorocyanurate, potassium hydrogen peroxisulfate or potassium permanganate, sodium hypochlorite generates chlorine rapidly due to the presence of the acid as illustrated by the following reaction schemes:

$$NaClO + HCl = NaCl + HClO$$

$$2HClO = 2HCl + O_2$$

$$HClO + HCl = H_2O + Cl_2$$

If the transition metal is present, sodium hypochlorite is decomposed sequentially by the catalytic action of the acid as the hydrogen ion source adsorbed onto the endo cuticle or that of the metals set forth in the claim, generates chlorine and oxygen and performs vigorous oxidized decomposition locally as illustrated by the following reaction schemes:

$$2MO + Cl_2O \rightarrow M_2O_3 + Cl^-$$

$$M_2O_3 + ClO^- \rightarrow M_2O_3ClO^-$$

$$M_2O_3ClO^- \rightarrow 2MO + Cl + O_2$$

where M is the transition metal.

In this instance, sodium hypochlorite is used in an amount of 3 to 12% by weight, calculated as the available chlorine, on the basis of the weight of the animal fiber to be treated.

Due to the abovementioned oxidized decomposition, the scales of the animal fiber are decomposed from the inside to such an extent that they no longer retain their original shape, and are thus stripped off.

What is claimed is:

1. A method of modifying animal fiber goods by stripping off scales covering the surface of the animal fibers comprising:

(a) treating animal fibers to cause chemicals which act as an oxidation catalyst to be adsorbed only in the hydrophilic portions of the scales of the fibers;

(b) immersing the treated animal fibers in an aqueous solution of an oxidizing agent whereby vigorous oxidative decomposition occurs in said hydrophilic portions due to the action of the oxidation catalyst so that the scales of the animal fibers are destroyed from the inside and stripped off; and (c) further treating the animal fiber in a solution containing a reducing agent.

2. The method as defined in claim 1 wherein, in step (a), said fibers are treated in a saturated solution of a neutral salt containing an acid, in a saturated aqueous solution of a simple salt consisting of a strong acid and a weak base, or with an acid vapor whereby hydrogen ions are adsorbed in said hydrophilic portions.

3. The method as defined in claim 1 wherein, in step (a), said fibers are treated with an aqueous solution containing chlorides, sulfates, nitrates or acetates of transition metal elements, magnesium or aluminum, or with a dispersion of said salts in an organic solvent so as to cause said transition metal elements, magnesium or aluminum ions to be adsorbed in said hydrophilic portions.

4. The method as defined in claim 2 wherein said neutral salt is selected from the group consisting of sodium chloride, sodium sulfate, potassium chloride and magnesium sulfate.

5. The method as defined in claim 2 or 4 wherein the acid in said saturated solution of a neutral salt is selected from the group consisting of hydrochloric acid, sulfuric acid, phosphoric acid, sulfamic acid, isoamylsulfonic acid, o-phenylsulfonic acid, metaphosphoric acid, sulfosalicylic, octylsulfuric acid, dodecylsulfuric acid, pyrosulfuric acid, dodecylsulfonic acid, dichloroacetic acid, monochloroacetic acid, formic acid, glycolic acid, acetic acid, propionic acid, benzoic acid and p-nitrophenol.

6. The method of claim 6 wherein said simple salt is an ammonium salt, calcium salt or magnesium salt of a strong acid.

7. The method as defined in claim 1, 2 or 3 wherein said oxidizing agent is selected from the group consisting of sodium hypochlorite, sodium chlorite, sodium chlorocyanurate, potassium chlorocyanurate, chloroamine monopersulfate, peracetate, potassium permanganate and sodium peroxide.

8. The method as defined in claim 1, 2 or 3 wherein said reducing agent is selected from the group consisting of sodium pyrosulfite, sodium hyposulfite, sodium sulfite and thioglycolic acid.

9. Animal fiber goods treated according to the method of any one of claims 1, 2 and 3.

* * * * *

UNITED STATES PATENT AND TRADEMARK OFFICE

CERTIFICATE OF CORRECTION

PATENT NO. : 4,396,388

DATED : August 2, 1983

INVENTOR(S) : HOJO ET AL

Figure 4:
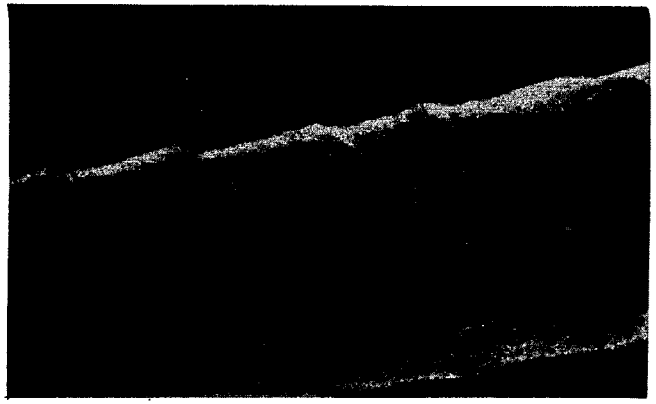
Figure 5:
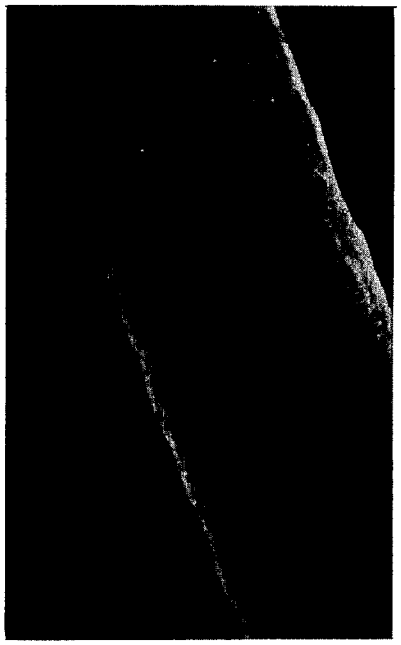

It is certified that error appears in the above-identified patent and that said Letters Patent are hereby corrected as shown below:

Col. 3, line 35: change "Photo No. 1" to --FIG. 4--.
Col. 3, line 38: change "Photo No. 2" to --FIG. 5--.
Col. 4, line 1 of the table beginning at line 7 of the column: amend "pryosulfite" to --pyrosulfite--.
Col. 7, lines 28 and 29: change "Photo No. 1" to --FIG. 4--.
Col. 7, line 34: change "Photo No. 2" to --FIG. 5--.
Col. 7, line 39: change "Photo No. 1" to --FIG. 4--.
Col. 8, line 3: change "Photo No. 2" to --FIG. 5--.
Claim 5, line 6 (Col. 10, line 24): after "salicylic" add --(acid)--.
Claim 6, line 1 (Col. 10, line 29): change "6" to --2--.

Signed and Sealed this

*Twenty-ninth* Day of *May 1984*

[SEAL]

*Attest:*

GERALD J. MOSSINGHOFF

*Attesting Officer*

*Commissioner of Patents and Trademarks*